US009546778B2

(12) United States Patent
Frost et al.

(10) Patent No.: US 9,546,778 B2
(45) Date of Patent: Jan. 17, 2017

(54) LED MODULE WITH PROTECTIVE FILM

(71) Applicant: OSRAM GmbH, Munich (DE)

(72) Inventors: Tobias Frost, Burglengenfeld (DE); Peter Sachsenweger, Zeitlarn (DE); Ralph Bertram, Penang (MY); Gerhard Holzapfel, Rain (DE)

(73) Assignee: Osram GmbH, Munich (DE)

( * ) Notice: Subject to any disclaimer, the term of this patent is extended or adjusted under 35 U.S.C. 154(b) by 193 days.

(21) Appl. No.: 14/390,030

(22) PCT Filed: Apr. 12, 2013

(86) PCT No.: PCT/EP2013/057720

§ 371 (c)(1),
(2) Date: Oct. 2, 2014

(87) PCT Pub. No.: WO2013/153211

PCT Pub. Date: Oct. 17, 2013

(65) Prior Publication Data

US 2015/0078017 A1 Mar. 19, 2015

(30) Foreign Application Priority Data

Apr. 13, 2012 (DE) ..... 10 2012 206 077

(51) Int. Cl.
*F21V 19/00* (2006.01)
*F21V 15/00* (2015.01)
(Continued)

(52) U.S. Cl.
CPC ..... *F21V 19/0055* (2013.01); *F21K 9/20* (2016.08); *F21V 15/00* (2013.01); *F21V 19/005* (2013.01);
(Continued)

(58) Field of Classification Search
CPC ..... F21V 15/00; F21V 17/12; F21V 19/005; F21V 19/0055; F21V 21/03; F21V 3/04; F21V 11/00; F21V 31/00; F21Y 2101/02; F21Y 2101/00; G02B 1/14; F21K 9/30; F21K 9/20
(Continued)

(56) References Cited

U.S. PATENT DOCUMENTS 5,908,234 A 6/1999 Kreeft
2006/0062953 A1 3/2006 Trigg et al.
(Continued)

FOREIGN PATENT DOCUMENTS

DE 2402323 A1 7/1975
DE 19753801 A1 6/1999
(Continued)

OTHER PUBLICATIONS

International Search Report issued for PCT/EP2013/057720 on Jun. 20, 2013.
(Continued)

*Primary Examiner* — Laura Tso
*Assistant Examiner* — Naomi M Wolford
(74) *Attorney, Agent, or Firm* — Viering, Jentschura & Partner mbB

(57) ABSTRACT

An LED module may include at least one passage opening from a first side of the LED module to a mounting side of the LED module, located opposite the first side. The passage opening is formed in such a way that a screw for fixing the LED module to a mounting element can be inserted into the passage opening from the first side to the mounting side of the LED module, and with a film which, at least in part, is arranged in an adhesive manner on the first side of the LED module. The film has at least one structure which includes at
(Continued)

least one piercing of the film in the area of the at least one passage opening of the LED module.

12 Claims, 3 Drawing Sheets

(51) Int. Cl.
*F21V 21/03* (2006.01)
*F21V 17/12* (2006.01)
*F21Y 101/00* (2016.01)

(52) U.S. Cl.
CPC ..... *F21V 21/03* (2013.01); *F21V 17/12* (2013.01); *F21Y 2101/00* (2013.01)

(58) Field of Classification Search
USPC ..... 362/382
See application file for complete search history.

(56) References Cited

U.S. PATENT DOCUMENTS

2008/0247178 A1 10/2008 Holder
2011/0157891 A1* 6/2011 Davis et al. ..... B29C 45/14467 362/244
2012/0243232 A1* 9/2012 Bertram et al. ..... F21K 9/00 362/249.02

FOREIGN PATENT DOCUMENTS

DE 102009047489 A1 6/2011
GB 1404220 A 8/1975

OTHER PUBLICATIONS

Office Action issued for corresponding DE 102012206077.4 on Dec. 12, 2012.

* cited by examiner

LED MODULE WITH PROTECTIVE FILM

RELATED APPLICATIONS

The present application is a national stage entry according to 35 U.S.C. §371 of PCT application No.: PCT/EP2013/057720 filed on Apr. 12, 2013, which claims priority from German application No.: 10 2012 206 077.4 filed on Apr. 13, 2012, and is incorporated herein by reference in its entirety.

TECHNICAL FIELD

Various embodiments relate to an LED module.

BACKGROUND

The related art discloses LED modules with a protective film for protection against contamination. Furthermore, these LED modules can have passage openings for the mounting of the LED module on a mounting element by means of screws. If the film is not also to be screwed in place during the mounting, then the film has to be removed before the mounting, but this means that the LED module is no longer protected against dirt during the mounting. The risk of contamination is increased in particular on building sites, for example as a result of drilling or dust produced by other building site work. Above all, LED modules having silicone potting are very susceptible to dust and other contaminants. Furthermore, in general, for example in the event of upside-down mounting of an LED module by means of screw fixing, there is the problem that the effort for mounting such an LED module is increased by the risk of the screws falling out.

SUMMARY

Various embodiments provide an LED module which permits easier mounting and is adequately protected against contamination.

The LED module according to the present disclosure includes at least one passage opening from a first side of the LED module to a mounting side of the LED module, located opposite the first side, wherein the passage opening is formed in such a way that a screw for fixing the LED module to a mounting element may be inserted into the passage opening from the first side to the mounting side of the LED module. Furthermore, the LED module has a film which, at least in part, is arranged in an adhesive manner on the first side of the LED module. The film has at least one structure which includes at least one piercing of the film in the area of the at least one passage opening of the LED module.

As a result of the piercing of the film in the area of the passage opening, insertion of a screw into the passage opening for the mounting of the LED module is made possible, without having to remove the film during the mounting. Thus, the LED module is advantageously also protected against contamination during the mounting. Furthermore, as a result of forming the film with a structure in the form of at least one piercing, the screw is retained in the passage opening by the film on its own, even without being tightened, which makes the mounting of the LED module according to the present disclosure considerably easier. In this case, a piercing may in particular represent a slit-like discontinuity in the film which, in the normal state, i.e. in particular with a mechanically stress-free, flat orientation of the film, results in no visible opening.

In various embodiments, the structure is formed in such a way that, in order to remove from the passage opening a screw that penetrates the film, has at least in part been inserted into the passage opening of the LED module but not tightened, a force which is greater than the weight of the inserted screw is required.

As a result, for example in the event of upside-down mounting of the LED module, a screw pushed into the passage opening and through the at least one piercing may not fall out again on its own, in particular under the influence of the force of gravity. Thus, above all the upside-down mounting may be simplified greatly, which is also associated with the positive effect of a reduced expenditure of time during the mounting.

In various embodiments, the LED module has on the first side at least one recess, in which the at least one passage opening is arranged, a diameter of the recess being greater than a diameter of the passage opening.

The diameter of the recess may, furthermore, be formed in such a way that a diameter of a screw head of a screw inserted into the passage opening is smaller than the diameter of the recess and larger than the diameter of the passage opening. The recess provides a multiplicity of advantageous refinements, such as that the film is not also screwed in place as the screw is tightened, with simultaneous coverage of the recess by the film.

In various embodiments, the film is arranged on the first side of the LED module in such a way that it covers an opening of the recess, at least in part, when a screw is not inserted. This covering of the opening of the recess ensures that no dirt may get into the recess and into the passage opening of the LED module.

Advantageously, the film may be deformed, at least in the area of the recess, in such a way that a screw with screw head may be inserted into the recess and into the passage opening in the recess and tightened. In this way, the LED module may be protected in the area of the recess by being covered by the film, in particular before the mounting, but at same time the film may also be left on the LED module during the mounting, since it does not interfere during the insertion of a screw, as a result of the elastic or deformable properties of said film. Thus, the LED module may also be protected against contamination during mounting, in particular in the area of the recess and in the area of the passage opening for the screw.

In various embodiments, as a screw inserted into the passage opening of the LED module is tightened, no film is located between the screw head and a base of the recess of the LED module. This may be brought about, in particular, by the film, which covers the opening of the recess at least in part, not projecting further over the edge of the opening of the recess than the dimension of the depth of the recess. This has the enormous advantage that the film is prevented from being simultaneously screwed in place, by which means the strength of the screw connection is ensured in the long term.

However, applications are also conceivable in which the film is simultaneously screwed in place, in order for example to compensate for geometric irregularities or to damp vibrations or else, given appropriate shaping of the film, to retain the screw additionally.

For the configuration of the at least one structure of the film, a multiplicity of possible configurations that may be combined are available. The structure of the film may include a closed piercing in the form of a cut-out. Furthermore, the structure of the film may have a plurality of piercings, which are arranged so as to cross at a point.

Moreover, the structure of the film may include a cut-out and a plurality of piercings, wherein the piercings are arranged on a boundary line of the cut-out. Furthermore, the structure of the film may have a plurality of piercings, which are formed as a perforation. By means of these configuration variants of the structure of the film, firm retention of a screw inserted into the passage opening may be made possible. For example, the screw may be retained by clamping the neck of the screw by means of the structure of the film. The screw may be inserted only partly into the passage opening, so that the screw head is still located outside the recess.

In various embodiments, the film may be arranged on the first side of the LED module in such a way that it covers an opening of the recess, at least in part, when a screw is inserted into the passage opening. In this variant, the screw may be prevented from falling out by the at least partial covering of the opening of the recess by the film. For example, this may be brought about in that, by means of appropriate deformable formation of the film in the area of the recess, the structure deforms as the screw is inserted and, following the insertion of the screw, returns to its initial position again and in particular covers the opening of the recess again, at least in part.

Furthermore, the structure of the film may be formed in such a way that the film makes contact, at least in part, with the screw head of a screw inserted into the passage opening. In particular, the film may be formed in such a way that, as a screw is inserted, said film deforms in the area of the recess in such a way that, as a result of the deformation of the film resting laterally on the screw head, a force is exerted on the screw head and, in particular by means of the film, a clamping action on the screw head is effected, so that the screw, which has not yet been tightened, is retained in the passage opening.

Furthermore, in at least one area which is not arranged in contact with the first side of the LED module, the film may have an adhesive layer. This may serve as a trap for contaminants, such as dust or fluff, which are picked up by the adhesive layer and held fast. By means of this refinement, the avoidance of soiling of the LED module may be optimized further.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
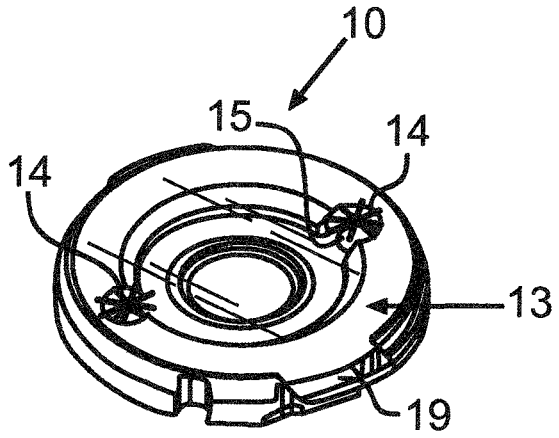
FIG. 1 shows a schematic representation of an LED module with a film according to an embodiment of the present disclosure.

FIG. 1 shows a schematic representation of an LED module 10 with a film 13 according to an embodiment of the present disclosure. In particular, this may also be an LED module including one or more organic LEDs. The film 13 may be adhesively bonded to a first side 11 of the LED module 10. Furthermore, the film 13 may also be provided with a two-dimensional adhesive layer, which is also arranged in areas where said layer is not needed for fixing to the housing but serves as a trap for contaminants, such as dust or fluff, which are picked up and held fast by the adhesive layer. This adhesive layer does not have to be continuous but may also be applied partially or in a structured manner. In the case of an LED module 10 that is not sensitive to ESD (electrostatic discharge), it may be advantageous if the adhesion both of the film 13 to the LED module 10 and of contaminants to the film 13 is based on electrostatic adhesion. Furthermore, it may be advantageous to LED modules 10 to print the film 13 with important information, such as handling rules. Such handling rules, for example in the case of ESD-sensitive LED modules 10, may have advice relating to the handling of the modules, since it is not usual for installers or electricians to be trained in the handling of ESD-sensitive components and, for example on a building site, an environment suitable for ESD may be implemented only with great difficulty, if at all. One example of a further handling rule would be the advice that the LED module must not be touched in the area of the LEDs, nor may pressure be exerted on the LEDs.

Furthermore, the film 13 may project beyond the first side 11 of the LED module 10, for example in the form of a pull-off tab 19. Advantageously, the pull-off tab 19 may be arranged in the area of a plug for the power supply of the LED module 10 and, in particular, cover said area. Thus, the removal of the protective film may not be forgotten when the LED module 10 is commissioned, which could otherwise affect the product characteristics of the LED module 10, such as the service life or light characteristics of the latter. Furthermore, the LED module 10 illustrated in FIG. 1 has, by way of example, two passage openings 15, which extend from the first side 11 of the LED module 10 to the opposite, mounting side 12, in order to be able to fix the LED module 10 to a mounting element with screws 16, which may be inserted into said passage openings 15 and tightened. In the area of these passage openings 15, the film 13 has a structure 14. The latter is designed to retain a screw inserted into a passage opening 15. By means of this structure 14 of the film 13, the screws 16 provided may be retained in place mechanically and, in particular in the case of upside-down mounting, may not fall out. Therefore, firstly the mounting may be made considerably easier and, secondly, such threading, firm retention or clamping of the screws 16 by the structure 14 of the film 13 may be used as a preparation for mounting. Furthermore, as a result of a suitable structure 14 of the film 13, a fitter does not have to remove the film 13 before fitting the screws, which offers protection of the LED module 10 against contaminants and soiling even during the mounting. Furthermore, it is also possible to remove the film 13 as the last operation, for example following thorough cleaning of a building site. Thus, as a result of forming the film 13 with an adhesive layer as a trap for contaminants and by means of structures 14 in the area of the passage openings 15, which partly cover the latter, excellent protection against contamination before, during and also after the mounting of the LED module 10 may be brought about and, as a result of the structures 14 of the film 13, the mounting may be simplified enormously and the mounting time may be shortened considerably. Furthermore, a multiplicity of possibilities are available to form these structures 14 in order to be able to offer the best possible adhesion of the screw 16 and, at the same time, the maximum protection against contaminants.

Figure 2:
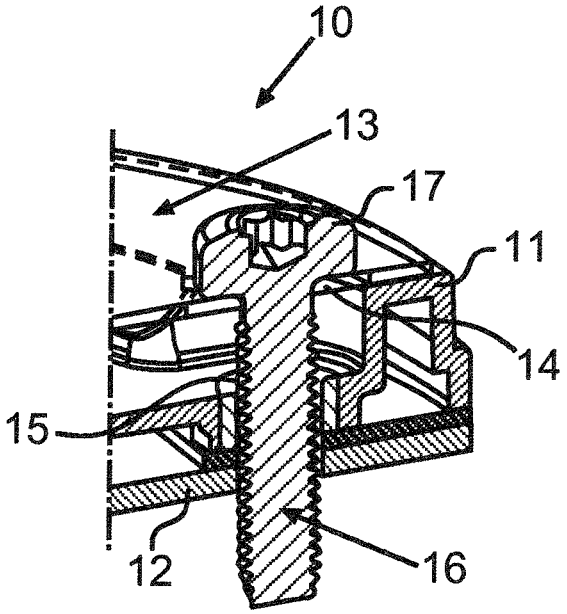
FIG. 2 shows a schematic representation of an LED module with a film and a screw retained by the structure of the film, according to an embodiment of the present disclosure.

FIG. 2 shows a schematic representation of an LED module 10 with a film 13 and a screw 16 retained by the structure 14 of the film 13, according to an embodiment of the present disclosure. Here, the structure 14 is implemented in such a way that a star structure of the piercings is used, on which a circle, in particular a circular cut-out, has been superimposed. As a result of the circular cut-out, the screw 16 may be inserted into the passage opening and retained by clamping the screw neck with the cut-out of the structure 14. Thus, the screw 16 may no longer fall out of the passage opening 15, even in the case of upside-down mounting, which makes the mounting considerably easier.

Figure 3:
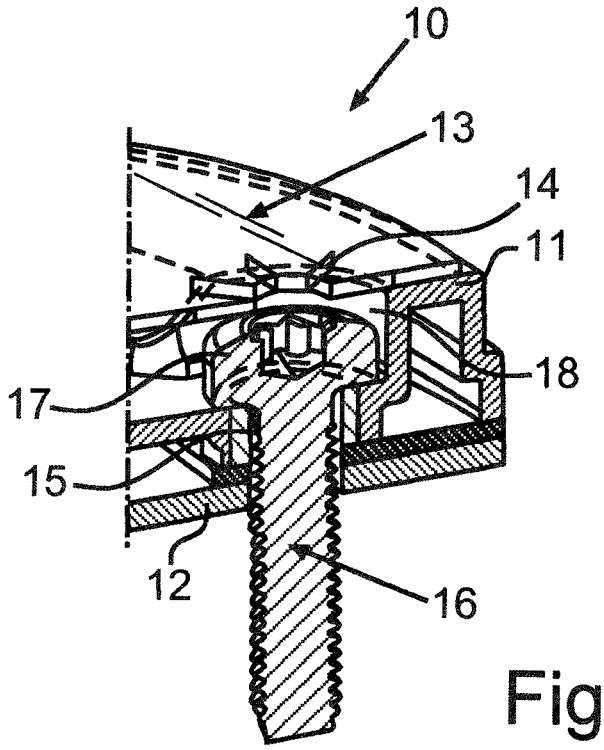
FIG. 3 shows a schematic representation of an LED module with a film, the structure of which covers the opening of a recess, at least in part, and a screw retained within the recess by the structure of the film, according to an embodiment of the present disclosure.

FIG. 3 shows a schematic representation of an LED module 10 with a film 13, the structure 14 of which partly covers a recess 18, and a screw 16 retained within the recess 18 by the structure 14 of the film 13, according to an embodiment of the present disclosure. In a manner analogous to FIG. 1, the structure 14 is formed with star-like piercings of the film 13 and a central circular cut-out. As a result of the deformation properties of the film 13, in particular in the area of the structure 14, and as a result of resilient formation of the film 13, a screw 16 may be inserted into the passage opening 15 of the LED module 10 even if the circular cut-out is smaller in diameter than the screw head 17. Furthermore, the LED module 10 is configured such that it has a recess 18, in which the passage opening 15 is arranged. Here, the diameter of the recess 18 is dimensioned such that the screw head 17 may be inserted into this recess 18. The fact that the structure 14 of the film 13 covers this recess 18, at least in part, means that the screw 16 may be retained in the passage opening 15 even without being tightened. Thus, the screw 16 may be inserted completely by a fitter in such a way that the structured area of the film 13 closes again following the insertion and, as a result, the screw 16 is reliably prevented from falling out. As a result of the deformable configuration of the film 13 and the fact that the structure 14 of the film 13 closes again, contamination of the LED module 10 may be prevented effectively, even in the area of the recess 18. A further advantage of the recess 18 is that, as the screw 16 is screwed in, no film 13 is located between the screw head 17 and the LED module 10, by which means the strength of the screw connection is permanently ensured.

Figure 4:
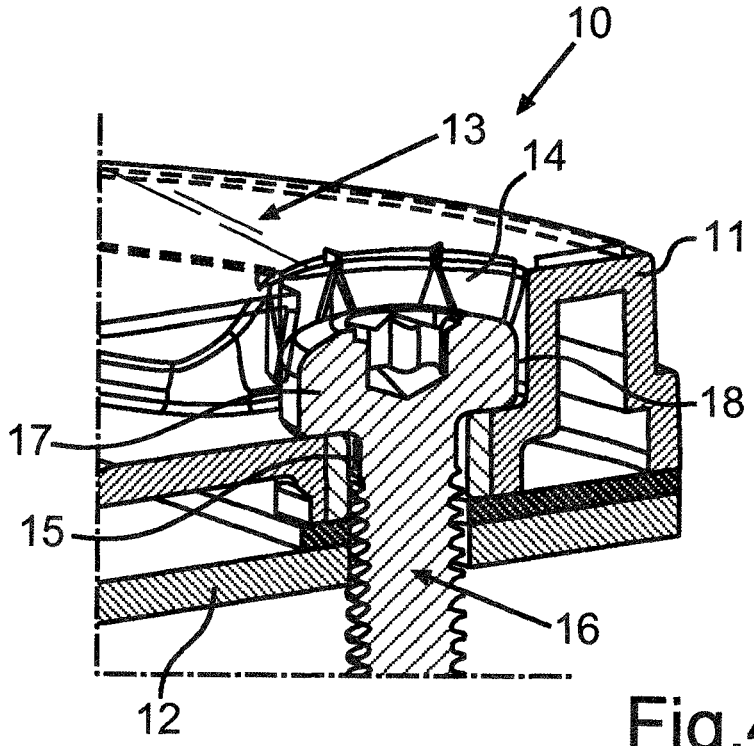
FIG. 4 shows a schematic representation of an LED module and a film with a structure which retains a screw in a recess of the LED module by means of deformation, according to an embodiment of the present disclosure.

FIG. 4 shows a schematic representation of an LED module 10 and a film 13 with a structure 14 which retains a screw 16 in a recess 18 of the LED module 10 by means of deformation, according to an embodiment of the present disclosure. In this embodiment, the structure 14 is implemented in such a way that it does not close again if the screw 16 is inserted completely into the recess 18, instead said screw is clamped by means of the structure 14 and is therefore retained. Furthermore, a combination of these configuration variants of the structure 14 is of course also conceivable, so that, for example, part of the star-like structure 14 is designed to be longer than another part of the structure 14, so that the structure 14 closes partly over the screw 16 and partly retains the screw 16 by clamping.

Apart from the star-like formation of the structure 14 of the film 13, a multiplicity of further configuration variants are possible, which will be explained below by using FIGS. 5*a*-5*i*.

Figure 5A:
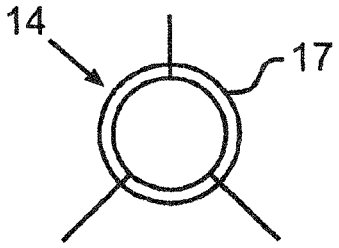
FIG. 5A shows a schematic representation of a first possible configuration of the structure of a film of an LED module, according to an embodiment of the present disclosure.
Figure 5B:
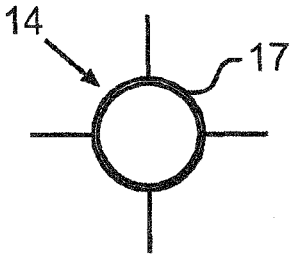
FIG. 5B shows a schematic representation of a second possible configuration of the structure of a film of an LED module, according to an embodiment of the present disclosure.
Figure 5C:
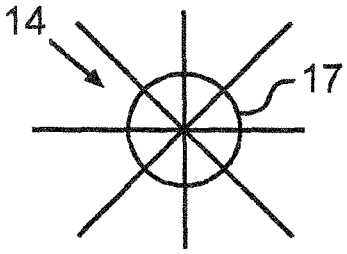
FIG. 5C shows a schematic representation of a third possible configuration of the structure of a film of an LED module, according to an embodiment of the present disclosure.

FIG. 5A shows a formation of the structure 14 as a star having only three rays. The piercings of the film 13 are in this case arranged radially symmetrically about a boundary line of a circular cut-out. The screw head 17 shown schematically may be somewhat larger than the circular punched-out portion. Furthermore, the circular punched-out portion is ideally exactly as large as the thread of the screw 16 in order, for example, to permit optimal clamping of the neck of the screw by the cut-out, as illustrated in FIG. 2. A smaller or larger thread diameter may be very advantageous in configurations according to FIGS. 3 and 4. Furthermore, the structure 14 may also be implemented as a star having four rays, as illustrated in FIG. 5B, or even more. Furthermore, the structure 14 may also be implemented as star-like piercings without a circular punched-out portion in the center, as illustrated schematically in FIG. 3*c*. This design variant is suitable in particular when the distance of the film 13 from the base of the recess 18 is sufficiently large, in particular when the diameter of the recess 18 is smaller than the depth of the recess 18, so that clamping of the film 13 between screw 16 and LED module 10 during screw fixing may be avoided. This configuration variant is additionally particularly advantageous since there is no occurrence of punching waste which, in a punching operation that is not carried out reliably, could remain on the LED module 10. It is thus possible to avoid this waste occurring at locations at which it is undesired, such as between the base of the recess 18 of the LED module 10 and the screw head 17.

Figure 5D:
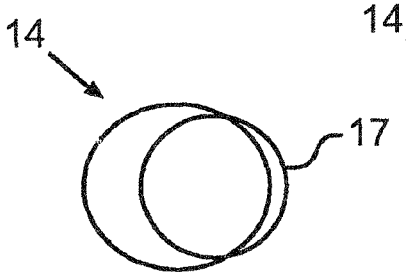
FIG. 5D shows a schematic representation of a fourth possible configuration of the structure of a film of an LED module, according to an embodiment of the present disclosure.
Figure 5E:
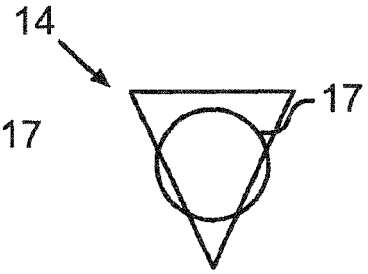
FIG. 5E shows a schematic representation of a fifth possible configuration of the structure of a film of an LED module, according to an embodiment of the present disclosure.

FIG. 5D shows a design variant in which the structure 14 includes a closed piercing, in particular a circular punched-out portion. In this case, preferably, this circular cut-out may have a diameter which is exactly as large as or larger than that of a screw head 17. Here, a screw 16 may be retained by the punched-out portion being fitted eccentrically with respect to the passage opening 15 into which the screw 16 may be inserted. If the screw 16 is inserted, it snaps partly under the film 13 and is retained by the film 13 until it is fixed, in particular until it is tightened. Furthermore, other forms of the cut-out are also possible, for example triangular, as illustrated in FIG. 5E, or else generally n-cornered. Such shapes of the cut-out are, moreover, also possible as a central punched-out portion with piercings of the film 13 at the boundary lines of the punched-out portion, analogous to FIGS. 5*a* and 5*b*.

Figure 5F:
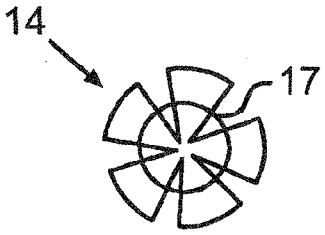
FIG. 5F shows a schematic representation of a sixth possible configuration of the structure of a film of an LED module, according to an embodiment of the present disclosure.

FIG. 5F shows a further possible configuration of the structure 14 of the film 13, once more with a closed piercing of the film 13 in the form of a cut-out. In this case, the star structure is not formed as a linear structure but as a star-like punched-out portion. Thus, the structure 14 of the film 13 may also be formed by triangular film components.

Figure 5G:
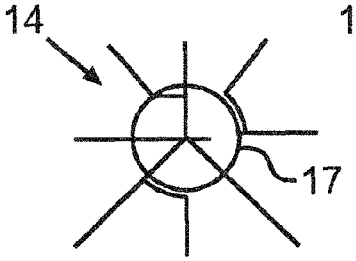
FIG. 5G shows a schematic representation of a seventh possible configuration of the structure of a film of an LED module, according to an embodiment of the present disclosure.

FIG. 5G shows a particularly preferred configuration of the structure 14 of the film 13. The structure 14 here includes a plurality of rectilinear piercings of the film 13, which cross at a point and, moreover, further piercings of the film 13 which are configured in the manner of a circular arc. By means of this configuration of the structure 14, the retaining mechanisms illustrated in FIG. 3 and FIG. 4 may be implemented at the same time. A further advantage is that there is also no occurrence here of punching waste, which could undesiredly remain at a point of the LED module 10.

Figure 5H:
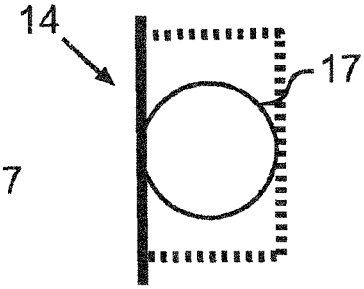
FIG. 5H shows a schematic representation of an eighth possible configuration of the structure of a film of an LED module, according to an embodiment of the present disclosure.
Figure 5I:
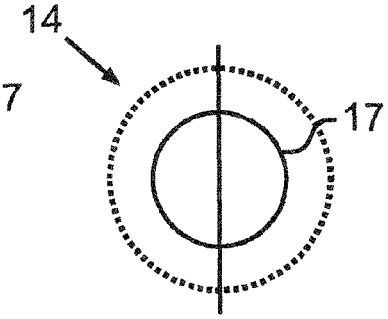
FIG. 5I shows a schematic representation of a ninth possible configuration of the structure of a film of an LED module, according to an embodiment of the present disclosure.

Furthermore, the piercing of the film 13 may also be formed as a perforation, as depicted, for example, in FIG. 5H and FIG. 5I.

FIG. 5H shows a structure 14 having a perforated intended rupture point and a single continuous punched-out portion. By means of this formation of the structure 14, dust is prevented from being able to fall into the LED module 10 through holes, such as the circular punched-out portions, and thus the protection against contamination of the LED module 10 is optimized. As the screw 16 is inserted, the perforated intended rupture point tears and opens the way for the screw 16. The screw 16 may then be retained by clamping or as illustrated in FIG. 2, 3 or 4, depending on the suitable configuration variation. Alternatively, the perforation on one side may also be left out in order to avoid waste film that is produced during the insertion of the screw 16 remaining in an undefined manner. The perforation may also be made in such a way that it does not tear or tears only partly and, instead, permits the film 13 to bend over in a defined way in this area.

FIG. 5I shows a further design variant of a structure 14 having a perforation. In this case, the perforation is made on both sides and forms a type of flap. In the middle there is arranged a continuous punched-out portion of the film 13, in order to facilitate the insertion of the screw 16. Furthermore, in this case the screw 16 may be retained by clamping, as illustrated in FIGS. 2 and 4.

Alternatively, it is also possible to omit the perforation, that is to say a linear punched-out portion is used only in the middle. In this case, the screw 16 is able to displace the film as it is inserted, by which means the screw 16 may simultaneously be retained. Furthermore, there is also the possibility of implementing all the structures 14 illustrated and mentioned with a continuous punched-out portion, also as a perforation, or with combinations of perforations and continuous punched-out portions.

Overall, in this way the disclosure provides an LED module which has a film with a structure in the area of screw holes, wherein the structure is designed to retain screws inserted into the screw holes, for example by means of clamping. Thus, firstly the mounting of such an LED module, in particular an upside-down mounting, may be made considerably easier since, by means of the structure of the film, the screws may be prevented from falling out, and, secondly, by means of this formation of the film, contamination of the LED module may be prevented much more effectively, since it is possible to remove the film only following the mounting of the LED module, the screw holes also being covered by the film, at least in part, and without the film also being screwed in place.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. An LED module comprising at least one passage opening from a first side of the LED module to a mounting side of the LED module, located opposite the first side, wherein the passage opening is formed in such a way that a screw for fixing the LED module to a mounting element is inserted into the passage opening from the first side to the mounting side of the LED module, and with a film which, at least in part, is arranged in an adhesive manner on the first side of the LED module, wherein the film has at least one structure which comprises at least one piercing of the film in the area of the at least one passage opening of the LED module, wherein the structure is formed in such a way that, in order to remove from the passage opening the screw that penetrates the film, has at least in part been inserted into the passage opening of the LED module but not tightened, a force which is greater than the weight of the inserted screw is required.

2. The LED module as claimed in claim 1, wherein the LED module has on the first side at least one recess, in which the at least one passage opening is arranged, a diameter of the recess being greater than a diameter of the passage opening.

3. The LED module as claimed in claim 2, wherein the film can be deformed, at least in the area of the recess, in such a way that the screw with screw head is inserted into the recess and into the passage opening in the recess and tightened.

4. The LED module as claimed in claim 3, wherein as the screw inserted into the passage opening of the LED module is tightened, no film is located between the screw head and a base of the recess of the LED module.

5. The LED module as claimed in claim 3,
wherein
the structure of the film is formed in such a way that the film makes contact, at least in part, with the screw head of the screw inserted into the passage opening.

6. The LED module as claimed in claim 2,
wherein
the film is arranged on the first side of the LED module in such a way that the film covers the recess, at least in part, when the screw is inserted into the passage opening.

7. The LED module as claimed in claim 1,
wherein
the film is arranged on the first side of the LED module in such a way that the film covers an opening of a recess, at least in part, when a screw is not inserted.

8. The LED module as claimed in claim 1,
wherein
the structure of the film comprises a closed piercing in the form of a cut-out.

9. The LED module as claimed in claim 1,
wherein
the structure of the film comprises a plurality of piercings, which are arranged so as to cross at a point.

10. The LED module as claimed in claim 1,
wherein
the structure of the film comprises a cut-out and a plurality of piercings, wherein
the piercings are arranged on a boundary line of the cut-out.

11. The LED module as claimed in claim 1,
wherein
the structure of the film has a plurality of piercings, which are formed as a perforation.

12. The LED module as claimed in claim 1,
wherein
in at least one area which is not arranged in contact with the first side of the LED module, the film has an adhesive layer.

* * * * *